US005589044A

United States Patent [19]

Scannell et al.

[11] Patent Number: 5,589,044

[45] Date of Patent: Dec. 31, 1996

[54] ELECTRODE FOR ELECTROLYSIS CELLS

[75] Inventors: Robert Scannell, Pfungstadt; Bernd Busse, Darmstadt; Helmut Vormwald, Linsengericht, all of Germany

[73] Assignee: Heraeus Electrochemie GmbH, Hanau, Germany

[21] Appl. No.: 431,898

[22] Filed: May 1, 1995

[30] Foreign Application Priority Data

Jun. 1, 1994 [DE] Germany ..... 44 19 274.6

[51] Int. Cl.[6] ..... C25B 11/02; C25B 1/36

[52] U.S. Cl. ..... 204/286; 204/280; 205/527

[58] Field of Search ..... 204/286, 280, 204/99; 205/527; C25B 1/36, 11/02

[56] References Cited

U.S. PATENT DOCUMENTS 4,022,679 5/1977 Koziol et al. ..... 204/286

4,364,811 12/1982 Fabian et al. ..... 204/220

FOREIGN PATENT DOCUMENTS 0159138 10/1985 European Pat. Off. ..... 204/280

0204126 12/1986 European Pat. Off. .

*Primary Examiner*—Bruce F. Bell

*Attorney, Agent, or Firm*—Felfe & Lynch

[57] ABSTRACT

An electrode for mercury chlor-alkali electrolytic cells includes a plurality of activated electrode elements consisting of flat sections standing on edge and having recesses on their lateral surfaces which extend from the lower edge to the upper edge of the lateral surfaces. The recesses in the lateral surfaces promote the transport of the gas bubbles produced electrolytically away from the area of the electrode gap and achieve a boundary surface as free of gas bubbles as possible between the anode and the electrolyte in the area of the electrode gap for the purpose of improving the energy efficiency.

11 Claims, 6 Drawing Sheets

ELECTRODE FOR ELECTROLYSIS CELLS

BACKGROUND OF THE INVENTION

The invention pertains to electrolytic cells, especially mercury chlor-alkali cells with current feed rods or power feed bolts and with current distributors in the form of flat sections standing on-edge a certain distance apart, which are welded at their lower edges to activated electrode elements perpendicular to the current distributor sections. The activated electrode elements consist of flat sections up to 2-mm-thick, standing on-edge, with vertical outside surfaces. The number of individual activated electrode elements is larger than the number of current distributors, the electrode elements being installed with a gap of at least 2 mm between them.

U.S. Pat. No. 4,022,679 describes an electrode for mercury chlor-alkali electrolytic cells with current feed rods or current feed bolts. The electrode has flat sections spaced a certain distance apart, which are connected at their lower edge to activated electrode elements, which are perpendicular to the sections. The number of individual activated electrode elements is larger than the number of power-supplying parts, and the individual elements as seen in cross section, have a tapering lower edge, which is designed essentially in semicircular form. The problem with these circular or semicircular designs has to do with the discharge of the gas bubbles which form during electrolysis, because these bubbles interfere with the exchange of ions in the electrolytic gap between the semicircular sections and the mercury cathode, and yet there is no way for these bubbles to escape quickly. As a result, it must anticipated that a kind of gas bubble "cushion" will form in the lower area of the anode profile.

U.S. Pat. No. 4,364,811 discloses an anode for mercury chlor-alkali electrolytic cells, where the current is supplied by way of a rod or bolt, which is connected to activated electrode elements designed as flat sections, by power distributors in the form of rectangular sections running transversely. The current distribution sections distribute the current and are mounted crosswise to the flat electrode sections. Here, too, there is the danger that a gas cushion will form in the electrode gap or below the lower horizontal edge of the electrode elements, with the result that it becomes impossible for a rapid electrochemical reaction to occur because of the insufficient supply of ions, the reaction itself being hindered by the production of gas. Even though the three conductor planes with optimally dimensioned flat sections leads to a favorable power distribution, there is nevertheless the problem of achieving a rapid electrochemical reaction in the electrode gap and of the interference with this reaction caused by the production of gas bubbles and the formation of a gas cushion.

The problem of the electrochemical reaction also plays an important role in membrane electrolytic cells, as can be seen from EP No. 204,126. To avoid the interference with the transmission of power caused by gas bubbles and to achieve an improvement in the energy efficiency, the electrode elements adjacent to the membrane are provided with recesses. Because these recesses have the effect of increasing the surface area of the activated electrode, they promote a better electrochemical reaction and make it easier for the gas to escape.

SUMMARY OF THE INVENTION

The task of the invention is to design the electrodes, i.e., the anodes, for chlor-alkali electrolytic cells in such a way that the gas can escape more easily from the electrode gap and so that a boundary surface as free as possible of gas bubbles is made available between the anode and the electrolyte in the area of the electrode gap. Furthermore, the electrode voltage is to be decreased so that electrolysis can be carried out with a higher degree of energy efficiency.

The task is accomplished by providing recesses in the lateral surfaces of the electrode, each recess extending from the lower edge to the upper edge of the electrode. Recesses having a rectangular cross section can be machined in the electrode elements.

It has been found especially advantageous that the turbulence of the electrolyte-gas mixture in the electrode gap is increased. As a result, the electrode voltage can be advantageously decreased.

Another advantage is to be seen in the increase in the active surface area along the sides. In a preferred embodiment, the recesses are designed in the shape of U's, as seen in cross section looking down from above. Especially when the recesses are designed in the form of hollow parallelepipeds, a significant increase in the active surface area along the sides is obtained, with the result that a rapid electrochemical reaction with improved efficiency is possible.

The electrode elements are preferably elements in which the U-shaped recesses have been produced by a rolling operation; the essential advantage of this method is that large numbers of these electrode elements can be manufactured inexpensively. After the recesses have been rolled into the strand, it can be separated into the individual electrode elements by a cutting operation. It is also possible, however, to produce the recesses by means of a machining operation.

DETAILED DESCRIPTION OF THE PREFERRED EMBODIMENT

Figure 1:
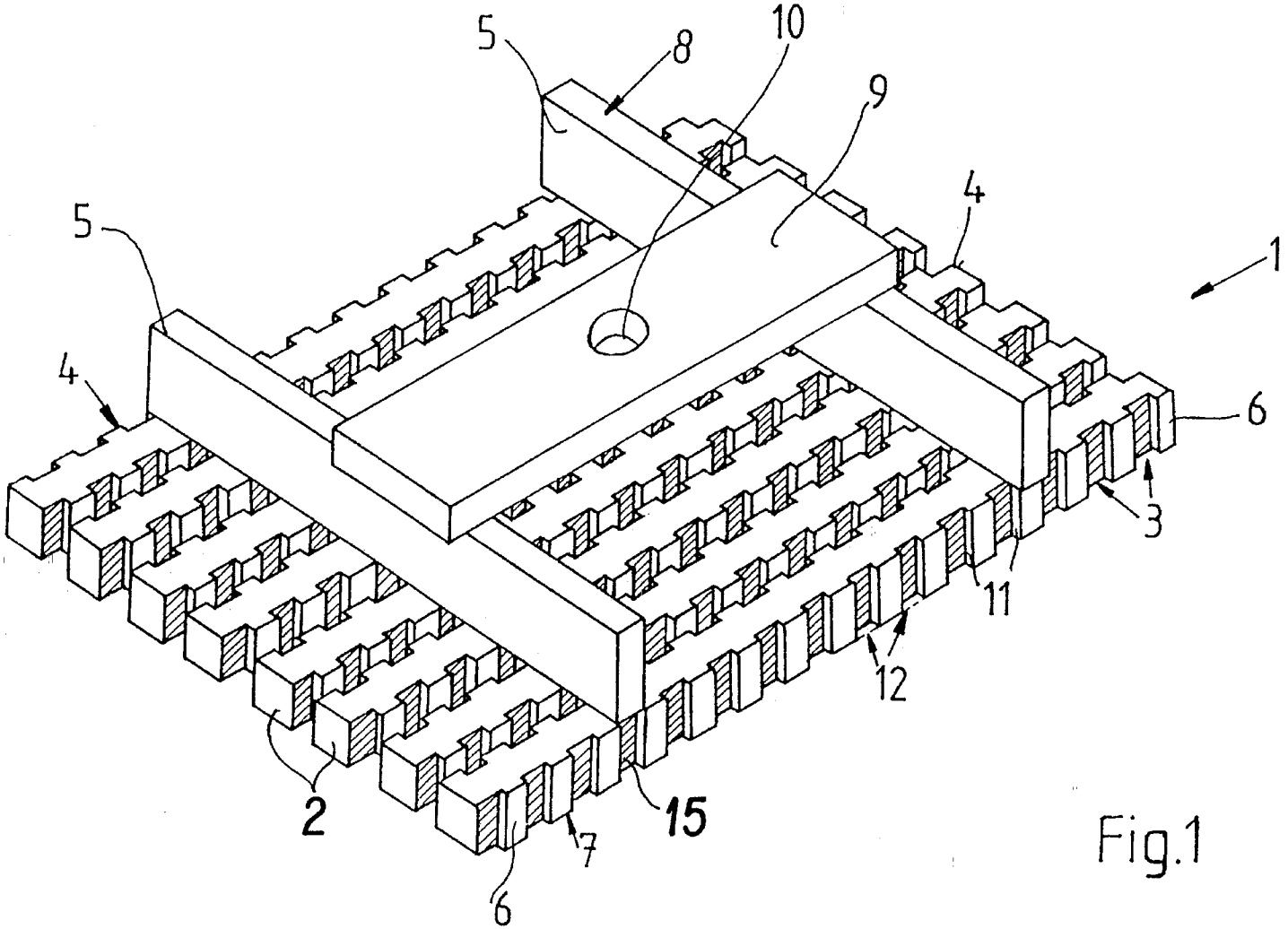
FIG. 1 is a perspective diagram of an electrode for electrolytic cells, the active electrode elements of which have recesses on their lateral surfaces.

According to FIG. 1, electrode 1 consists of a plurality of bar-like electrode elements 2, which are provided along their sides with recesses 3 and are welded at their upper surface 4 to current distributors 5 in the form of flat sections. The top surfaces 4 define a substantially horizontal plane. At their lower surface and in the area of their lateral surfaces 6, 11, 15, electrode elements 2 have an electrocatalytic coating, which is indicated symbolically by reference number 7. Top surfaces 8 of the rectangular sections serving as current distributors 5 are connected to a main current distributor 9, which has a connecting opening 10 for the electrical and mechanical connection to a current feed bolt (not shown);

this is a so-called three-plane electrode, which is known from U.S. Pat. No. 4,364,811. Because lateral surfaces 11 are much larger than base area 12 of the recess, a larger outside surface of electrode element 2 is available for the electrochemical reaction. The ratio of the base area 12 to the area of lateral surface 11 is in the range of 1:1.5–1:3, and preferably 1:2. Base area 12 is the horizontal projection of recess 3, calculated as d×b. The area of surface 11 is d×h.

Figure 2A:
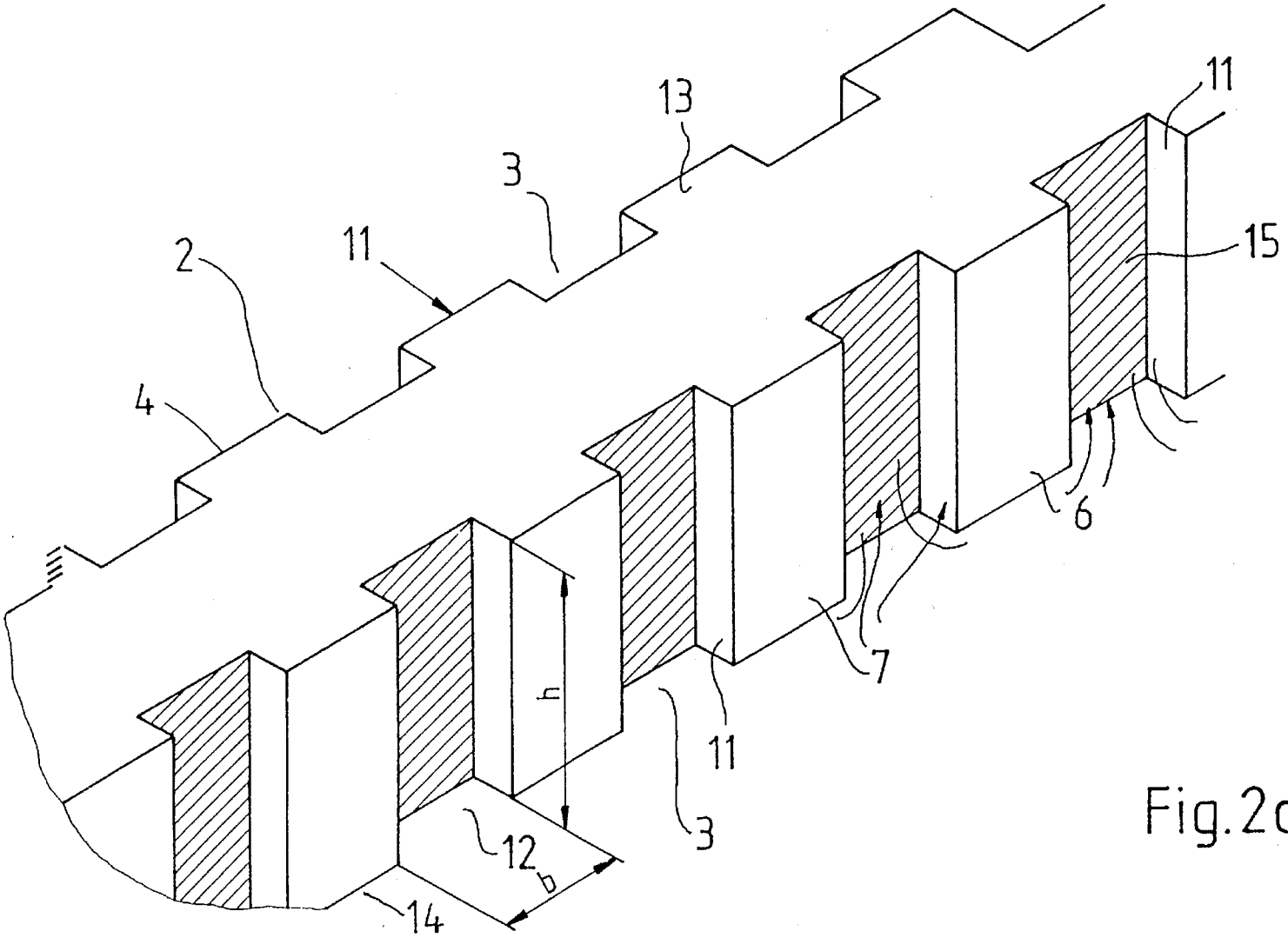
FIG. 2*a* shows a section of an electrode element, from which the geometric relationships of the recesses can be derived.

According to FIG. 2*a*, electrode element 2, recesses 3 have a rectangular cross section as seen from above and alternate in meander fashion with projecting areas 13, so that, recess 3 is always opposite a projecting area 13. The ratio of the width b of a recess to the height h of the recess is in the range of 1:2–1:2.5, so that the overall extent of side surfaces 11 available for the electrochemical reaction is much larger than that of associated base areas 12 of the recesses in the area of the surface of lower surface 14 and upper surface 4 of the electrode element. Electrocatalytic coating 7 is applied to the entire area of lower surface 14, i.e., the bottom surface facing the mercury, of lateral surfaces 6, of lateral surfaces 11, and of recess base surfaces 15; it is also possible in addition to provide top edge 4 of the electrode element with an electrocatalytic coating.

Figure 2B:
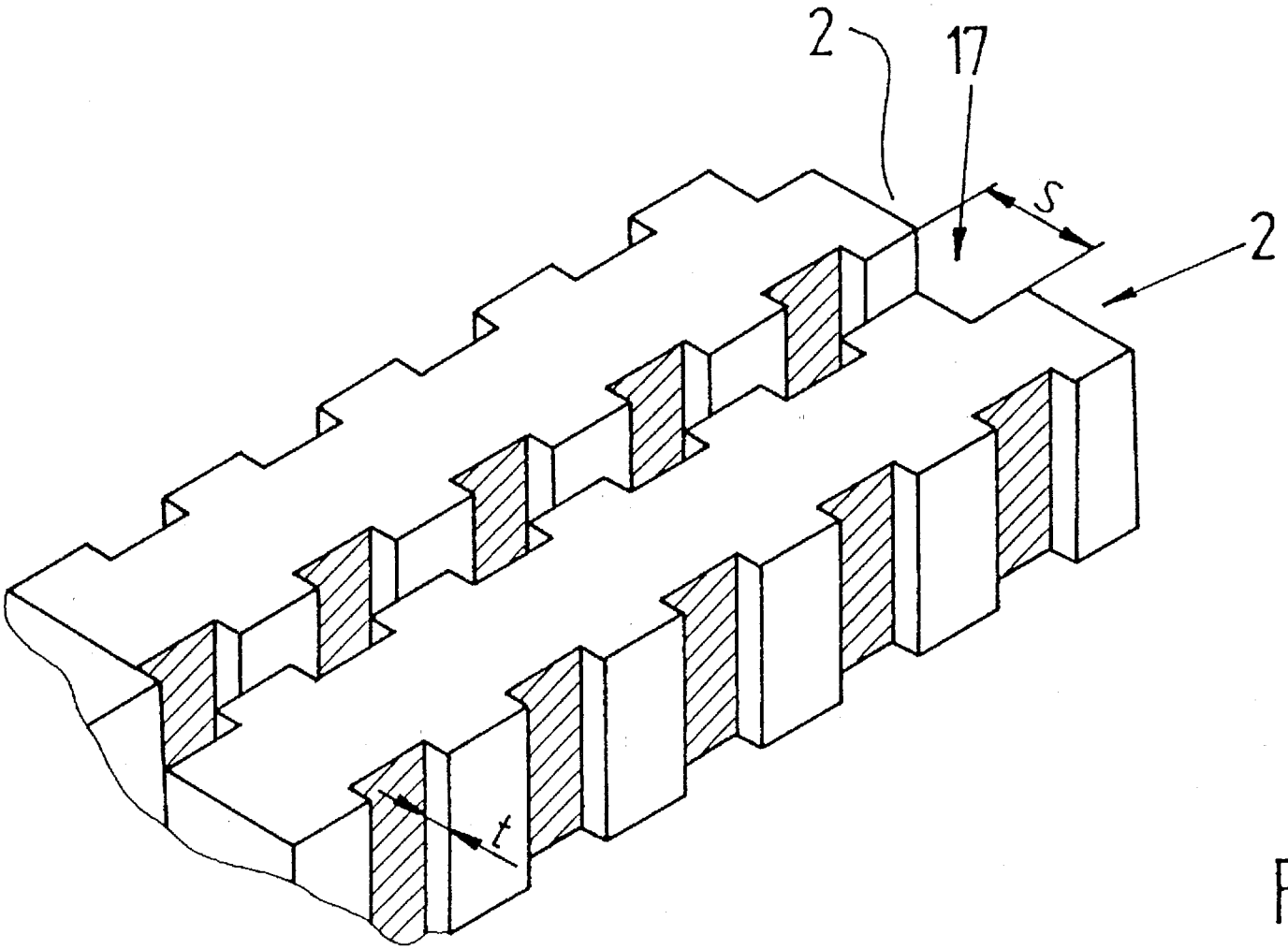
FIG. 2*b* shows sections of two adjacent electrode elements with the electrode gap between them.

FIG. 2*b* shows a section of two adjacent electrode elements 2, between which a meander-like electrode gap 17 is formed; because of the meander-like structure, both an increase in the area of the active surface and a channeling effect for the gas bubbles forming during the electrochemical reaction are obtained, so that turbulence of the gas bubbles in the electrolyte is increase, and it becomes possible for the gas bubbles to escape quickly. The ratio of the depth t of recesses 3 to gap width s between electrode elements 2 is in the range of 1:2–1:2.5.

Figure 3:
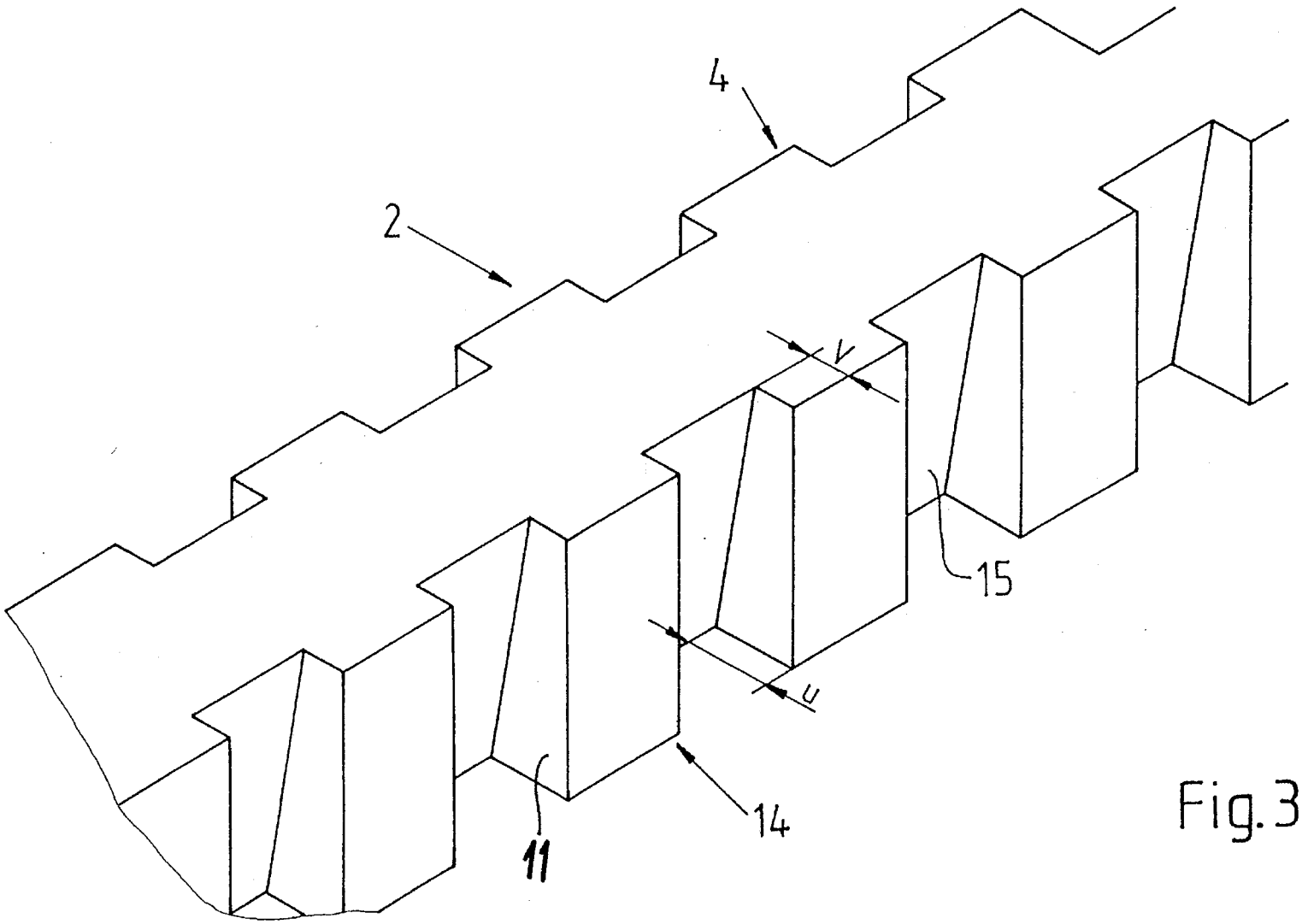
FIG. 3 shows a section of an electrode element with wedge-shaped recesses, the chimney-like cross section of which tapers down toward the top.

According to FIG. 3, have recesses 3 have parallel lateral surfaces 11 which are trapezoidal, the ratio of the depth u of the recess in the area of lower edge 14 to the depth v of the recess in the area of upper edge 4 being in a ratio of 1:1.8-2. The base surface 15 slopes upward and outward; the angle of inclination of recess surface 15 to the vertical is in the range of 10°–22°; in a preferred embodiment, it is about 15°.

Because of the wedge shape, the formation of gas bubbles occurs primarily in the especially active region of the electrode gap between the mercury cathode (not shown) and electrode element 2; the gas thus generated can be carried away effectively in the upward direction because of the space created by the recesses, which expands downward in a wedge-like fashion. Because of the tapering cross section, a type of chimney effect is obtained, which improves the discharge of the gas bubbles.

Figure 4:
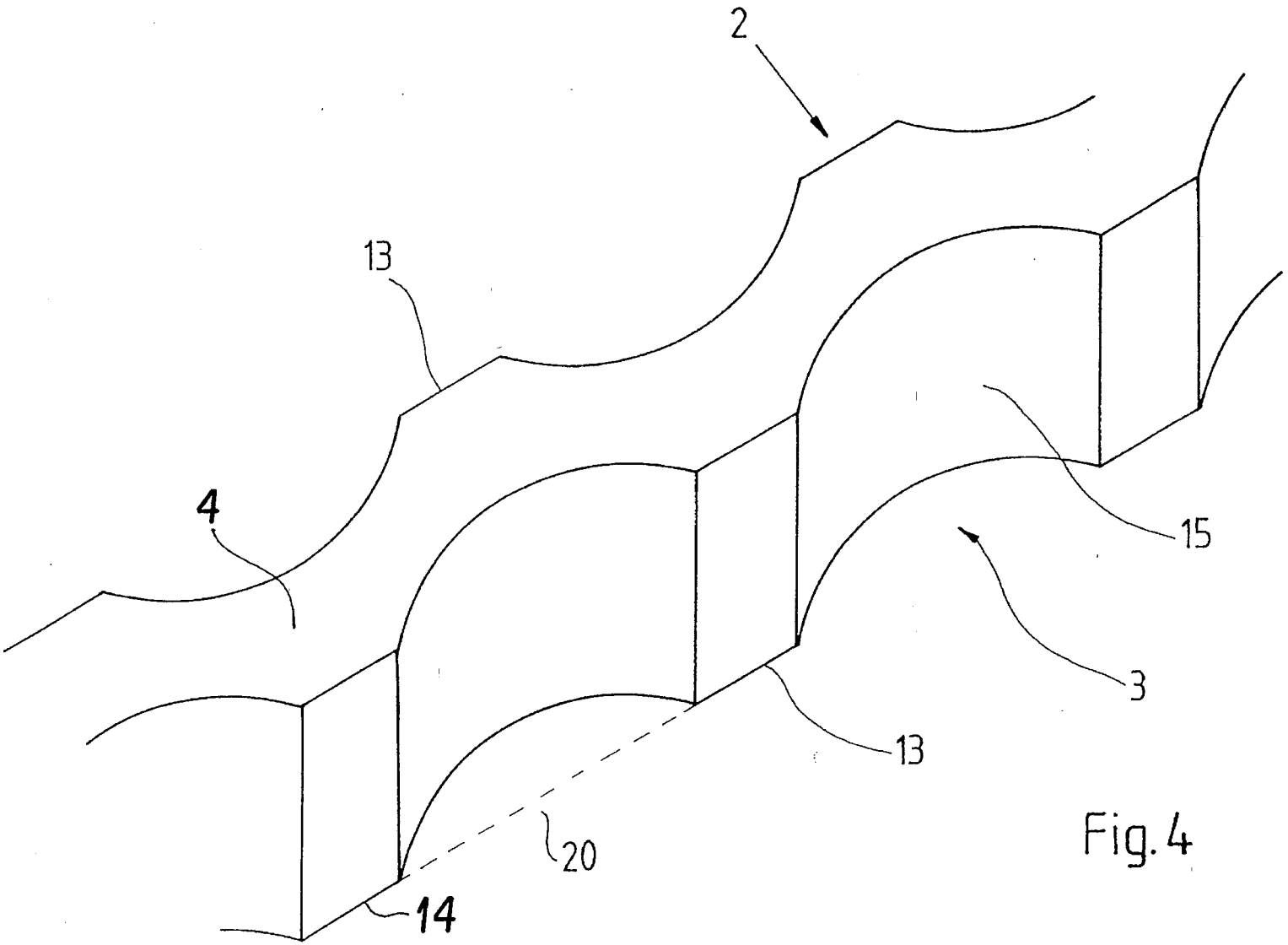
FIG. 4 shows a section of an electrode element with arcuate recesses.

FIG. 4 shows a part of an electrode element 2, which has recesses 3 which each have an arcuate cross section as seen from above. Recesses 3 and projecting areas 13 are arranged in meander fashion, so that the deepest point of each recess 3 is opposite a projecting area 13. Recesses 13 themselves are formed as chordal portions of a cylindrical surface, chords 20 of which are defined by upper edge 4 and lower edge 14 of the electrode elements. The ratio of the length of the chord to the imagined radius of the hollow cylinder is in the range of 1.6:1.2.

It has been found advantageous to produce hollow cylindrical recesses of this type by a machining operation, since this has proved to be relatively simple.

Figure 5:
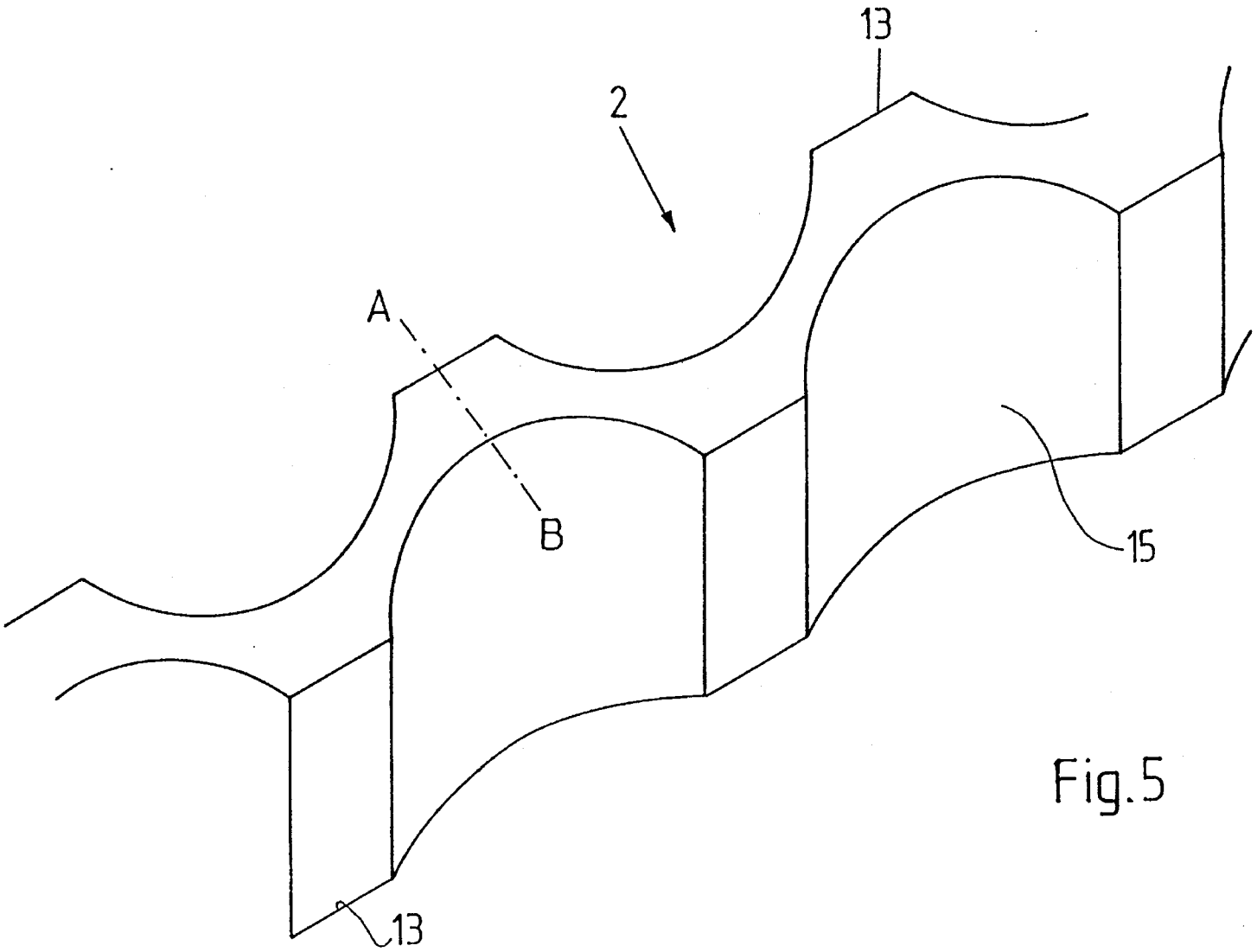
FIG. 5 shows a section of an electrode element with truncated cone-shaped recesses, which taper down toward the top.

FIG. 5 shows a section of an electrode element 2, recesses 3 of which are formed as chordal portions of a frustoidal surface. Recess surface 15, which is formed by the lateral surface of a truncated cone, forms an angle to the vertical in the range of 10°–22°; preferably 16° in the vicinity of projecting area 13, as seen in cross-section along line AB. Here, too, a chimney effect is obtained, similar to that provided by the wedge-shaped recesses described in conjunction with FIG. 3, according to which the gas bubbles collect in the lower area of the electrode and undergo an accelerated discharge.

We claim:

1. Electrode for mercury chlor alkali electrolytic cells comprising a plurality of active electrode elements in the form of parallel bars, each bar having opposed lateral sidewall surfaces, an upward facing top surface, and a downward facing bottom surface, said lateral sidewall surfaces being provided with recesses, each recess extending from said top surface to said bottom surface, at least two spaced apart current distributors extending transversely of said parallel bars and welded to said top surfaces, and means for supplying electrical current to said distributors.

2. Electrode as in claim 1 wherein said recesses on one said lateral surface of each bar are staggered from the recesses of the opposed lateral surface of said each bar.

3. Electrode as in claim 1 wherein said recesses each have an arcuate cross-section as seen from above.

4. Electrode as in claim 3 wherein said recesses on one said lateral surface of each bar are staggered from the recesses of the facing lateral surface of a parallel bar.

5. Electrode as in claim 3 wherein said recess is formed as a chordal portion of a cylindrical surface.

6. Electrode as in claim 4 wherein said recess is formed as a chordal portion of a frustoidal surface.

7. Electrode as in claim 1 wherein said recesses each have a rectangular cross-section as seen from above.

8. Electrode as in claim 7 wherein each recess is formed by a base surface which slopes upward and outward.

9. Electrode as in claim 8 wherein each recess further comprises parallel lateral surfaces which are trapezoidal.

10. Electrode as in claim 1 wherein each recess has a cross-sectional area which decreases from the bottom surface toward the top surface.

11. Electrode as in claim 1 wherein said top surface of said parallel bars define a substantially horizontal plane.

* * * * *